US009938936B2

(12) United States Patent
Kim

(10) Patent No.: US 9,938,936 B2
(45) Date of Patent: Apr. 10, 2018

(54) EGR COOLER HAVING BODY SHELL INTEGRATED WITH END TANK PART

(71) Applicant: KORENS CO., LTD., Yangsan (KR)

(72) Inventor: Tae Jin Kim, Yangsan (KR)

(73) Assignee: KORENS CO., LTD., Yangsan-si (KR)

( * ) Notice: Subject to any disclaimer, the term of this patent is extended or adjusted under 35 U.S.C. 154(b) by 0 days.

(21) Appl. No.: 15/305,092

(22) PCT Filed: Jun. 16, 2014

(86) PCT No.: PCT/KR2014/005262
§ 371 (c)(1),
(2) Date: Oct. 18, 2016

(87) PCT Pub. No.: WO2015/182807
PCT Pub. Date: Dec. 3, 2015

(65) Prior Publication Data

US 2017/0067417 A1 Mar. 9, 2017

(30) Foreign Application Priority Data

May 27, 2014 (KR) ..... 10-2014-0063478

(51) Int. Cl.
*F02M 26/32* (2016.01)
*F01N 3/02* (2006.01)
(Continued)

(52) U.S. Cl.
CPC ..... *F02M 26/32* (2016.02); *F01N 3/02* (2013.01); *F02M 26/00* (2016.02);
(Continued)

(58) Field of Classification Search
CPC ..... F02M 26/32; F02M 26/00; F01N 3/02; F28D 9/00; F28F 3/02; F28F 9/02; F28F 9/0219; F28F 2009/0285
See application file for complete search history.

(56) References Cited

U.S. PATENT DOCUMENTS 4,558,735 A * 12/1985 Meike ..... B23K 11/0046 165/131
5,158,135 A * 10/1992 Nagasaka ..... F28D 1/0341 165/153
(Continued)

FOREIGN PATENT DOCUMENTS

JP 11-013554 1/1999
JP 2004-177058 6/2004
(Continued)

*Primary Examiner* — David Hamaoui
(74) *Attorney, Agent, or Firm* — Lew IP Meister, PLLC

(57) ABSTRACT

Disclosed is an EGR cooler. The EGR cooler includes: a laminated tube core formed by laminating a plurality of gas channels side by side, wherein a fin structure for improving heat transfer is inserted into the gas channels and opposite ends of the gas channels are open; a body shell including a body part, in which the laminated tube core is accommodated, and a pair of end tank parts integrally provided at opposite ends of the body part; coolant pipes connected to the body shell so as to supply coolant to a periphery of the laminated tube core and to discharge the coolant to an outside; and a pair of flanges respectively fittingly coupled to the pair of end tank parts.

5 Claims, 10 Drawing Sheets

(51) Int. Cl.

| | |
|---|---|
| ***F28F 3/02*** | (2006.01) |
| ***F28D 9/00*** | (2006.01) |
| ***F02M 26/00*** | (2016.01) |
| ***F28F 9/02*** | (2006.01) |
| ***F28D 7/16*** | (2006.01) |
| ***F28D 21/00*** | (2006.01) |

(52) U.S. Cl.
CPC ..... *F28D 7/1684* (2013.01); *F28D 9/00* (2013.01); *F28D 21/0003* (2013.01); *F28F 3/02* (2013.01); *F28F 9/0221* (2013.01)

(56) References Cited

U.S. PATENT DOCUMENTS

| | | | | |
|---|---|---|---|---|
| 7,806,170 | B2 * | 10/2010 | Nakamura | F28D 7/1684 165/158 |
| 8,651,170 | B2 * | 2/2014 | Maeda | F28D 7/0041 165/152 |
| 8,925,624 | B2 * | 1/2015 | Kuroyanagi | F02M 25/0737 165/157 |
| 2006/0219394 | A1 * | 10/2006 | Martin | F28D 9/0043 165/157 |
| 2008/0202735 | A1 * | 8/2008 | Geskes | F28D 9/0006 165/166 |
| 2010/0044019 | A1 | 2/2010 | Maeda | |

FOREIGN PATENT DOCUMENTS

| | | |
|---|---|---|
| JP | 2004-257366 | 9/2004 |
| JP | 2014-511456 | 5/2014 |

* cited by examiner

EGR COOLER HAVING BODY SHELL INTEGRATED WITH END TANK PART

TECHNICAL FIELD

The present invention generally relates to an exhaust gas recirculation (EGR) cooler, and more particularly to an EGR cooler having a body shell integrated with end tank parts.

BACKGROUND ART

In general, an exhaust gas recirculation (EGR) system is a system for reducing nitrogen oxide (NOx) emissions by recirculating a portion of exhaust gas of an engine back to the engine cylinders such that a temperature of a combustion chamber is lowered due to the increase of $CO_2$ concentration of the intake air. The EGR system includes an exhaust gas heat exchanger, namely an EGR cooler, cooling exhaust gas using coolant. The EGR cooler cools hot exhaust gas at a temperature of about 700° C. down to a temperature of 150° C.~200° C.

FIG. 1 is a perspective view illustrating a conventional EGR cooler; and FIG. 2 is an exploded perspective view illustrating the conventional EGR cooler. As shown in FIGS. 1 and 2, the conventional EGR cooler, which is formed by assembly of an upper shell piece and a lower shell piece, includes: body shells 1 and 2, opposite ends of which are open; a laminated tube core fixedly disposed inside the body shells 1 and 2 and formed by laminating a plurality of gas channels 8 side by side by brazing the gas channels; burred plates 3 provided with a plurality of holes, into which each of the plurality of gas channels 8 is inserted, so as to support opposite ends of the laminated tube core; a pair of end tanks 4 covering end portions of the plurality of gas channels 8, wherein each is provided with an exhaust passage, a cross-sectional area of which is gradually reduced as approaching an end of the associated end tank defining an exhaust gas inlet or an exhaust gas outlet; and flanges 5 fittingly inserted into end portions of the end tanks 4 to be coupled to the end tanks 4. The pair of end tanks 4 is each configured to be coupled to the laminated tube core so as to cover an associated end of the laminated tube core, and thereby at the exhaust gas inlet, the exhaust gas is induced toward an inlet of each of the plurality of gas channels 8 and at the exhaust gas outlet, the exhaust gas via the plurality of gas channels 8 is combined and discharged. Further, the body shells 1 and 2 of the EGR cooler are coupled to a pair of coolant pipes 7 to allow a coolant to flow in and out. The coolant flows inside the body shells 1 and 2 while contacting with outer surfaces of the plurality of gas channels 8, and thereby cooling the exhaust gas flowing through the plurality of gas channels 8.

However, the conventional EGR cooler is disadvantageous in that as the end tanks 4 and the burred plates 3 are required to be separately assembled with the opposite ends of the gas channels 8 from the body shell, a large number of components are required, the assembly thereof is difficult, and thus manufacturing cost is high.

DISCLOSURE

Technical Problem

Accordingly, the present invention has been made keeping in mind the above problems occurring in the related art, and the present invention is intended to propose an EGR cooler having a body shell integrated with end tank parts enabling reduction of both the number of components and manufacturing cost.

Technical Solution

In order to achieve the above object, according to one aspect of the present invention, there is provided an EGR cooler including: a laminated tube core formed by laminating a plurality of gas channels side by side, wherein a fin structure for improving heat transfer is inserted into the gas channels and opposite ends of the gas channels are open; a body shell including a body part, in which the laminated tube core is accommodated, and a pair of end tank parts integrally provided at opposite ends of the body part; coolant pipes connected to the body shell so as to supply coolant to a periphery of the laminated tube core and to discharge the coolant to the outside; and a pair of flanges respectively fittingly coupled to the pair of end tank parts, wherein the body shell is provided by assembly of an upper shell piece and a lower shell piece, the upper shell piece including: a body upper part forming an upper part of the body part, and a pair of end tank upper parts each forming an upper part of the pair of end tank parts; and the lower shell piece including: a body lower part forming a lower part of the body part, and a pair of end tank lower parts each forming a lower part of the pair of end tank parts.

According to an embodiment of the present invention, the plurality of gas channels may be each provided with an enlarged portion that has a larger cross-section than the rest of the gas channel, at each of the opposite ends thereof; neighboring gas channels of the plurality of gas channels may meet each other at the enlarged portions to form a grooved portion; and the body shell may be provided with an embossment at an inner surface thereof, which comes into contact with the enlarged portion, to be inserted into the grooved portion.

According to the embodiment, the plurality of gas channels may be each provided with longitudinal embossments formed by being grooved inwardly, at surfaces of the enlarged portion, which come into contact with each other to be brazed, wherein the longitudinal embossments of the gas channels are formed identical to each other and are disposed to face each other.

According to the embodiment, the body shell may be provided with a plurality of paste holes at an area that comes into contact with the laminated tube core, so as to spread paste for rebrazing.

According to the embodiment, the lower shell piece may be provided with step-shaped overlapped parts, which are formed by being overlapped with the upper shell piece, respectively at the body lower part and each of the end tank lower parts, wherein the overlapped part of each of the end tank lower parts comes into contact with an area of an outer surface of an associated end tank upper part, and each of the pair of flanges is fittingly coupled to a periphery of a contact portion between the end tank upper part and the end tank lower part, thereby supplying a clamping force orienting a center of a cross-section of the end tank part.

According to the embodiment, each of the plurality of gas channels may be provided with a plurality of embossments at opposite sides thereof, wherein neighboring gas channels are brazed at the embossments abutting each other.

Advantageous Effects

According to the present invention having the above-described characteristics, an EGR cooler having a body shell integrated with end tank parts enables reduction of both the number of components and manufacturing cost. The present invention enables separation between exhaust gas and a coolant without having the end tanks of the conventional EGR cooler.

MODE FOR INVENTION

Figure 1:
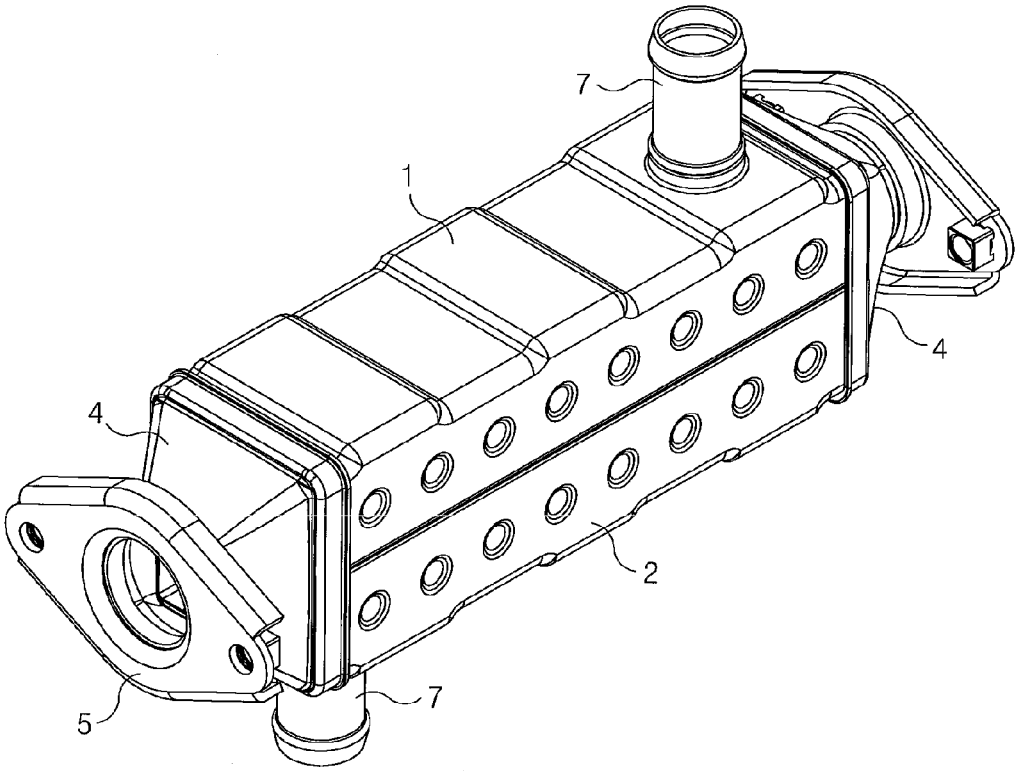
FIG. 1 is a perspective view illustrating a conventional EGR cooler.
Figure 2:
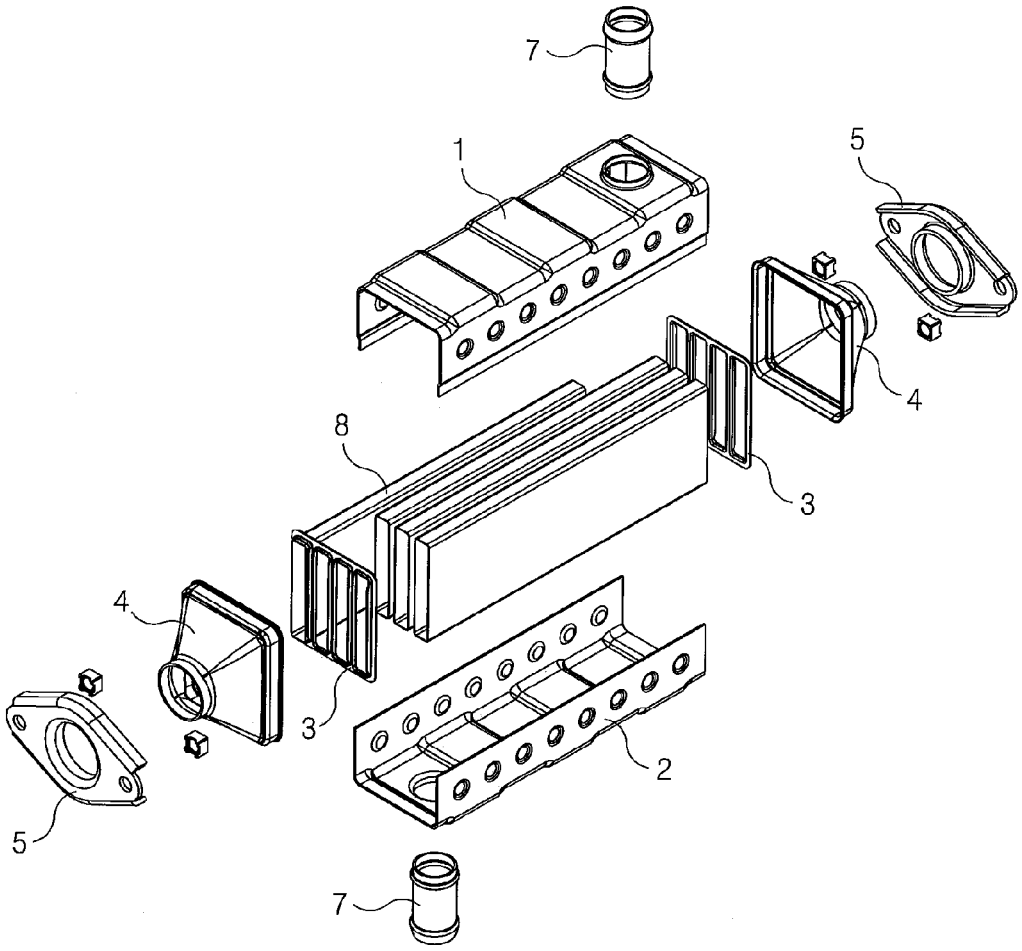
FIG. 2 is an exploded perspective view illustrating the conventional EGR cooler.

Reference will now be made in greater detail to an exemplary embodiment of the present invention, an example of which is illustrated in the accompanying drawings. The embodiment of the present invention described hereinbelow is provided for allowing those skilled in the art to more clearly comprehend the present invention. Therefore, it should be understood that the embodiment of the present invention may be changed to a variety of embodiments and the scope and spirit of the present invention are not limited to the embodiment described hereinbelow. In addition, it should be understood that the shape and size of the elements shown in the drawings may be exaggeratedly drawn to provide an easily understood description of the structure of the present invention.

Figure 3:
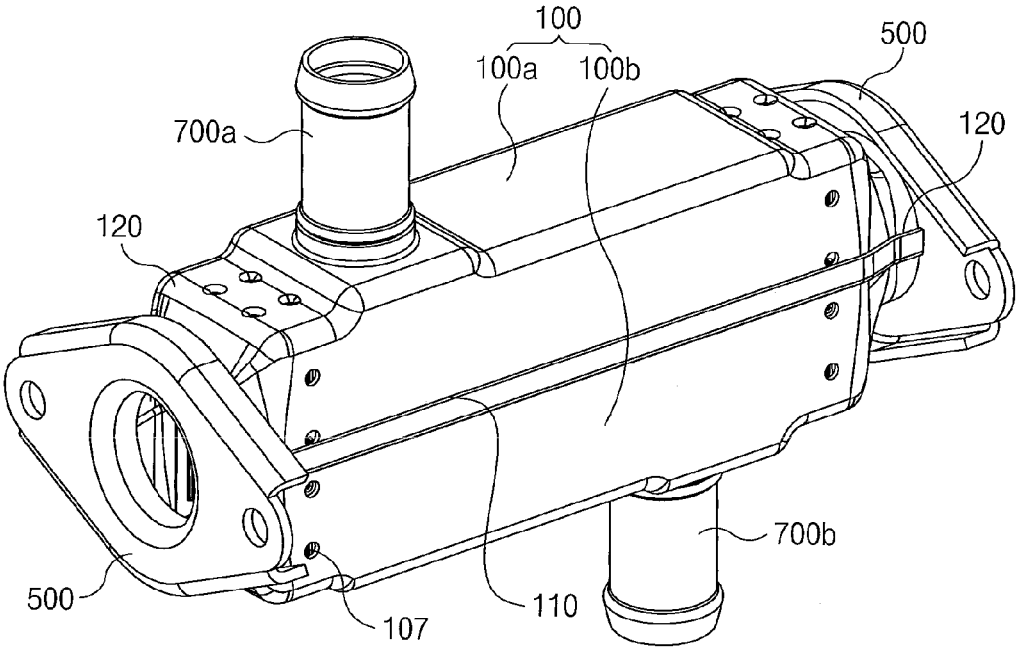
FIG. 3 is a perspective view illustrating an EGR cooler according to an embodiment of the present invention.
Figure 4:
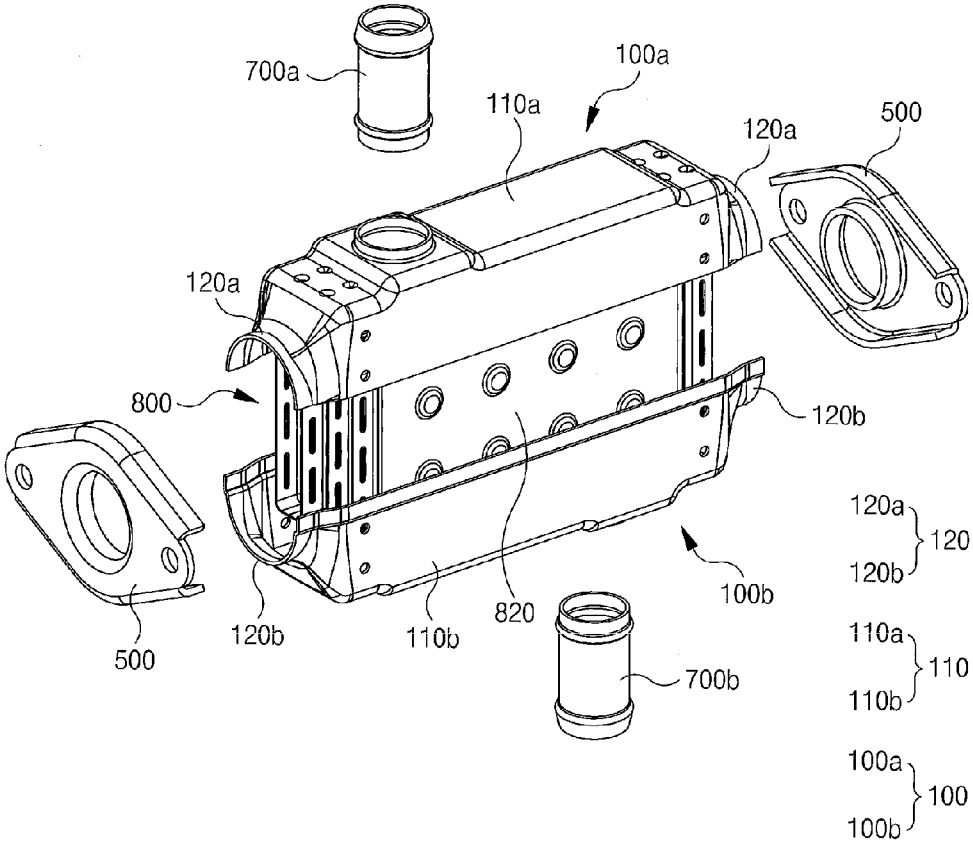
FIG. 4 is an exploded perspective view illustrating the EGR cooler according to the embodiment of the present invention.
Figure 5:
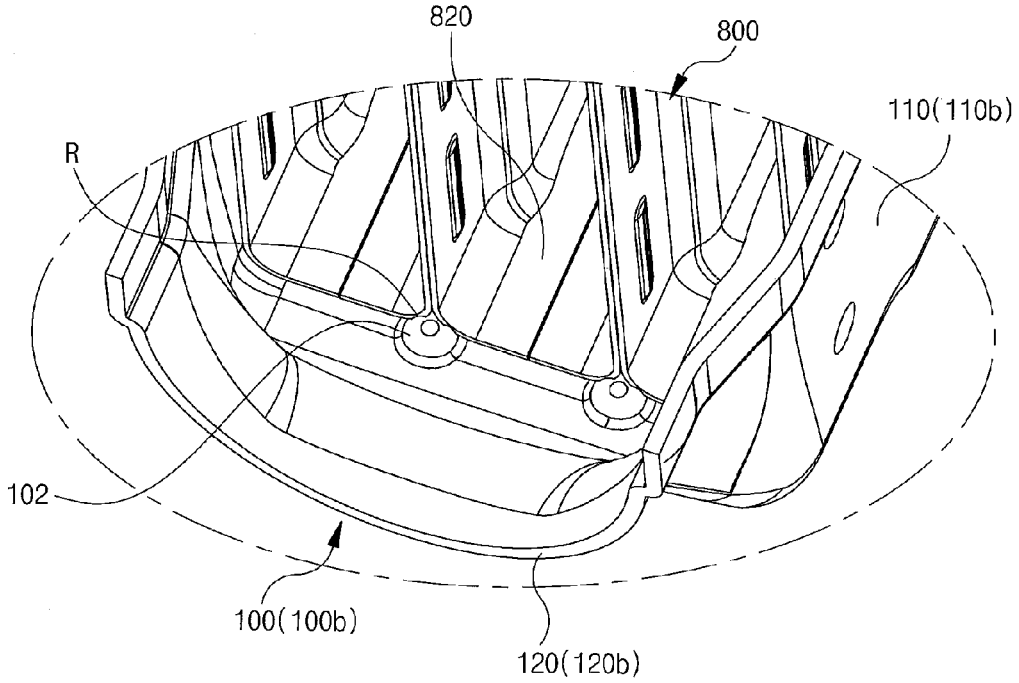
FIG. 5 is an enlarged view illustrating a structure capable of preventing leakage caused by a grooved portion formed at corners between neighboring gas channels.
Figure 6:
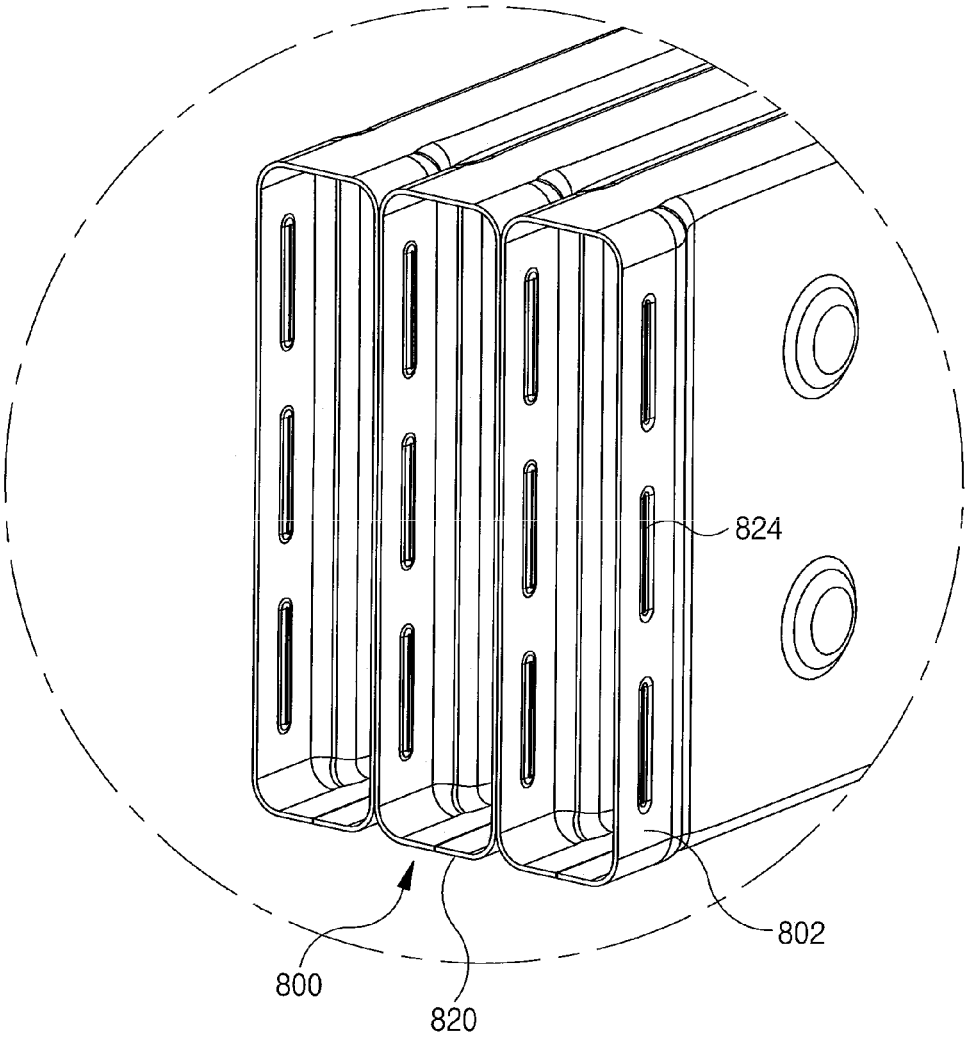
FIG. 6 is an enlarged perspective view illustrating a laminated structure of the gas channels.
Figure 7:
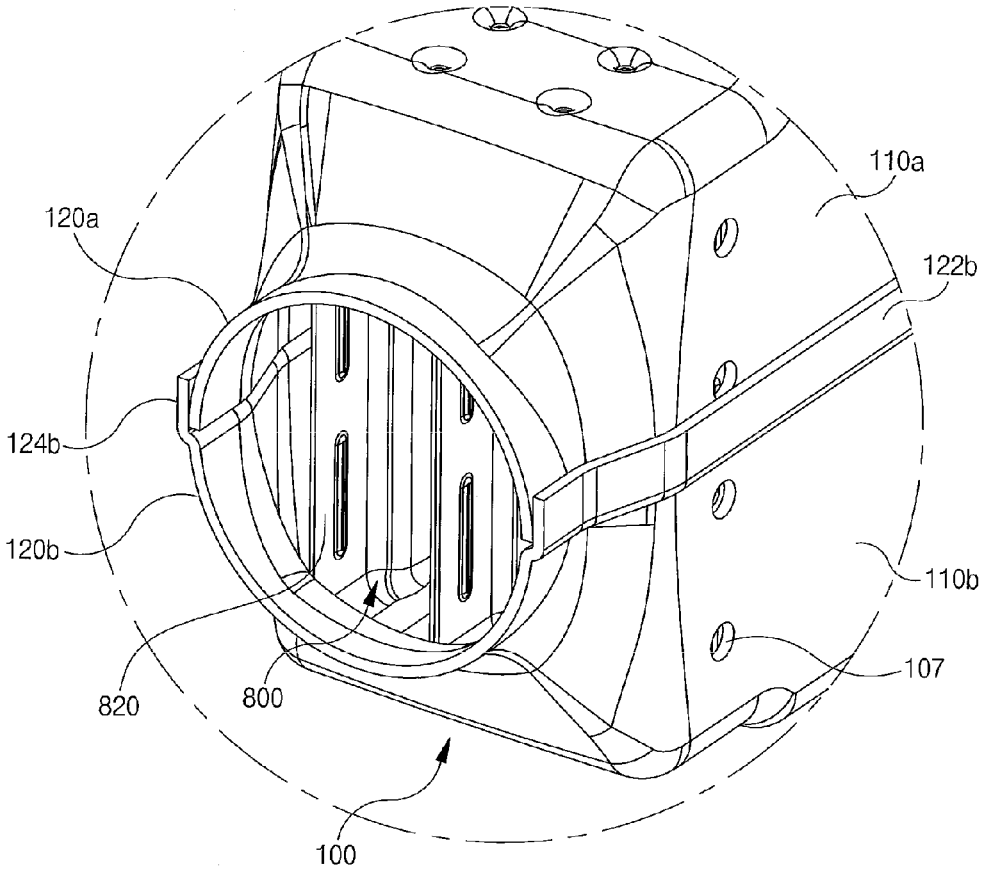
FIG. 7 is an enlarged perspective view illustrating an end portion of a body shell having paste holes.
Figure 8:
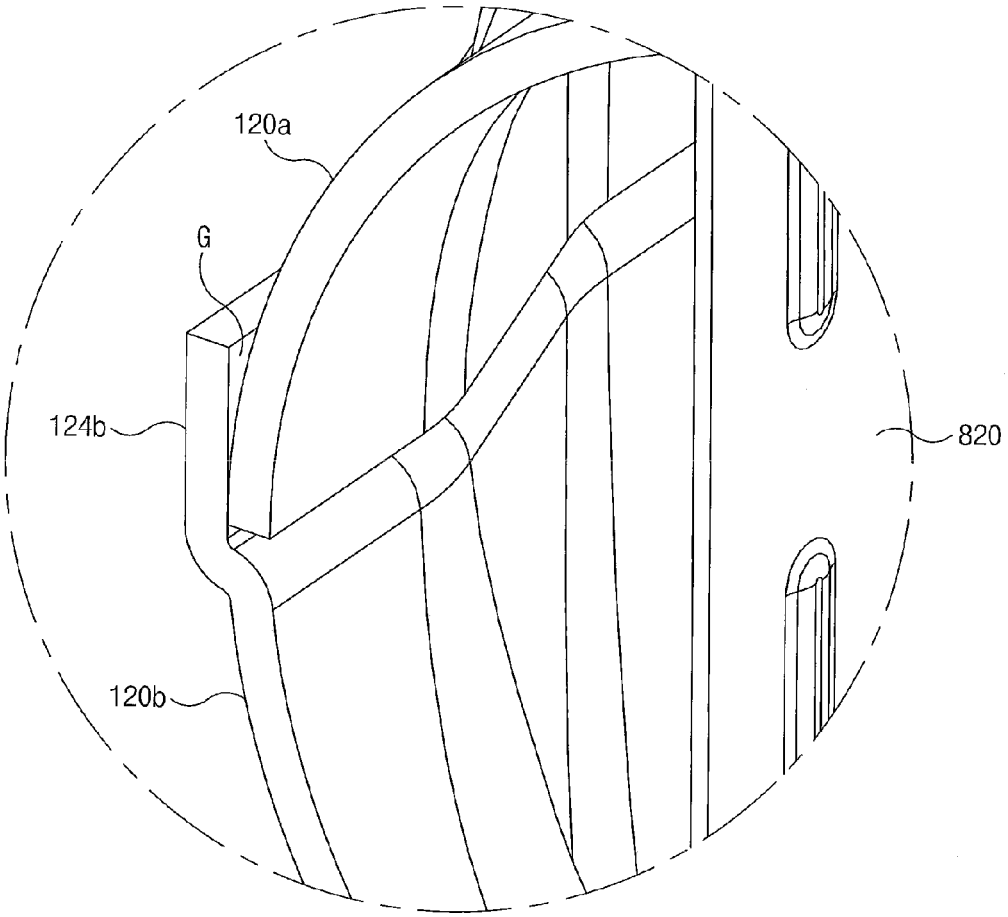
FIG. 8 is an enlarged view illustrating a structure of generating a gap between an upper shell piece and a lower shell piece of the end portion of the body shell when flanges are removed.
Figure 9:
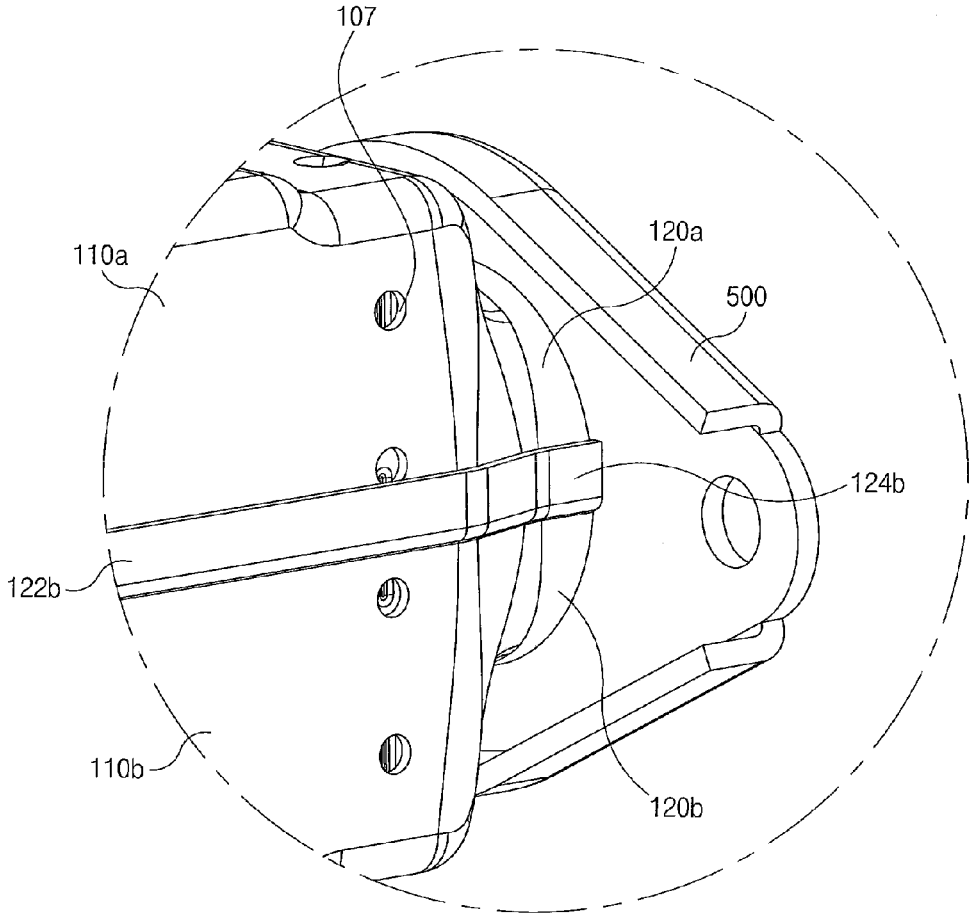
FIG. 9 is an enlarged view illustrating flanges connected to the end tank part of the end portion of the body shell so as to supplement the structure of generating the gap shown in FIG. 8.
Figure 10:
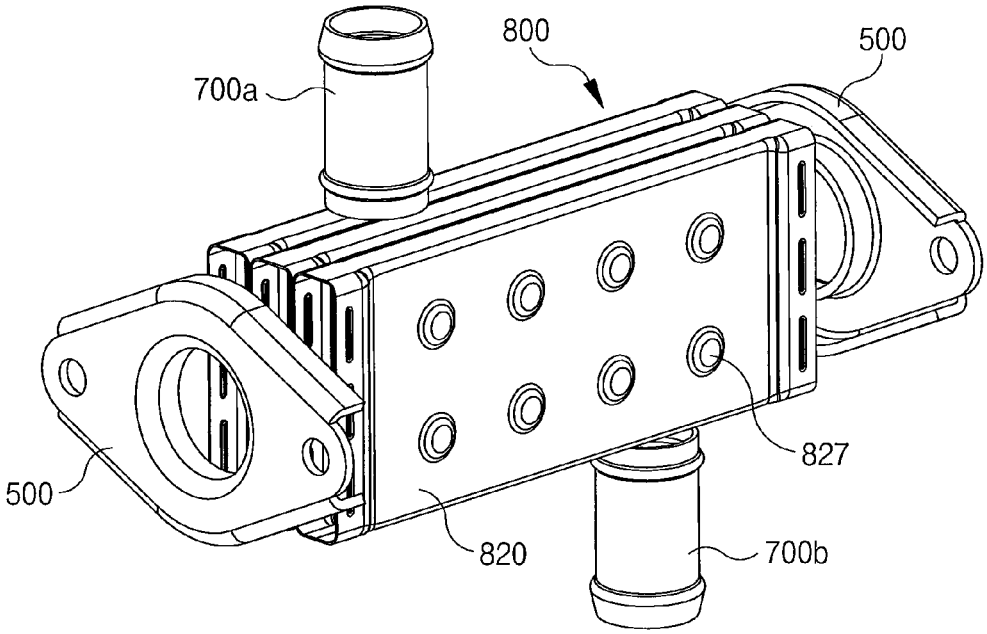
FIG. 10 is a perspective view illustrating the EGR cooler according to the embodiment of the present invention in a state where the body shell is removed.

FIG. 3 is a perspective view illustrating an EGR cooler according to an embodiment of the present invention; FIG. 4 is an exploded perspective view illustrating the EGR cooler according to the embodiment of the present invention; FIG. 5 is an enlarged view illustrating a structure capable of preventing leakage caused by a grooved portion formed at corners between neighboring gas channels; FIG. 6 is an enlarged perspective view illustrating a laminated structure of the gas channels; FIG. 7 is an enlarged perspective view illustrating an end portion of a body shell having paste holes; FIG. 8 is an enlarged view illustrating a structure of generating a gap between an upper shell piece and a lower shell piece of the end portion of the body shell when flanges are removed; FIG. 9 is an enlarged view illustrating flanges connected to the end tank part of the end portion of the body shell so as to supplement the structure of generating the gap shown in FIG. 8; and FIG. 10 is a perspective view illustrating the EGR cooler according to the embodiment of the present invention in a state where the body shell is removed.

As shown in FIGS. 3 to 10, the EGR cooler according to the embodiment of the present invention includes: a body shell 100; a laminated tube core 800 disposed within the body shell 100 so as to allow exhaust gas to flow; and a coolant inlet pipe 700*a* and a coolant outlet pipe 700*b* connected to the body shell 100 so as to supply coolant to a periphery of the laminated tube core 100 and to discharge the coolant to the outside. The EGR cooler according to the embodiment of the present invention further include a pair of flanges 500 directly connected to opposite ends of the body shell 100. Components of burred plates, which are conventionally required to be connected to opposite ends of the laminated tube core, are omitted, and also a part performing an end tank function is integrated into the body shell 100, and thereby components of the end tanks are omitted.

The laminated tube core 800 is formed by laminating a plurality of gas channels 820 side by side, wherein a fin structure for improving heat transfer is inserted into the gas channels and opposite ends of the gas channels are open. The plurality of gas channels 820 each has a quadrangular cross-sectional shape with rounded corners. Further, the opposite ends of the plurality of gas channels 820 are each provided with an enlarged portion that has a larger cross-section than the rest of the gas channel by increasing longitudinal and traverse widths. The enlarged portions between the gas channels 820 are brazed to form the laminated tube core 800. Except the brazed enlarged portions, it is preferred that a gap is provided between the gas channels 820 such that the coolant flows through the gap. Though not shown in the drawings, the laminated tube core 800 may include a plurality of wavy fins therein.

The body shell 100 include: a body part 110, in which the laminated tube core 800 is accommodated; and a pair of end tank parts 120 integrally provided at opposite ends of the body part 110. The pair of end tank parts 120 may include an exhaust gas inlet or an exhaust gas outlet. Further, the pair of end tank parts 120 is connected to the exhaust gas inlet or the exhaust gas outlet of the laminated tube core 800 while separated from a space that the coolant to flow provided inside the body shell 100.

The body shell 100 is formed by the assembly of an upper shell piece 100*a* and a lower shell piece 100*b*. The upper shell piece 100*a* includes: a body upper part 110*a* forming an upper part of the body part 110; and a pair of end tank upper parts 120*a* forming an upper part of the pair of end tank parts 120. The lower shell piece 100*b* includes: a body lower part 110*b* forming a lower part of the body part 110; and a pair of end tank lower parts 120*b* forming a lower part of the pair of end tank parts 120.

As mentioned above, the laminated tube core 800 is provided with an enlarged cross-sectional part 802 at each of the opposite ends thereof by brazing the enlarged portions of the gas channels 820. Here, the enlarged cross-sectional part 802 of the laminated tube core 800 is fittingly inserted into a border between the body part 110 and the end tank parts 120 or into a location adjacent to the border. Thereby, the end tank parts 120, each of which is configured such that one end thereof is connected to the gas channels 820 and the other end thereof is connected to an exhaust gas outlet or an inlet, can be separated from the space that allows the coolant to flow provided inside the body shell 100.

As shown in FIG. 5, end portions of the neighboring gas channels 820, namely the enlarged portions, have rounded corners, so when the end portions meet each other, a grooved portion R is formed by the rounded shape. According to the present invention, the body shell 100 is provided with an embossment 102 to be inserted into the grooved portion R at an inner surface thereof. The embossment 102 is provided on a contact surface between the gas channels 820 and the body shell 100, wherein the contact surface is defined as the border between the body part 110 and the end tank parts 120 or the location adjacent to the border.

As shown in FIG. 6, the gas channels 820 are each provided with longitudinal embossments 824 formed by being grooved inwardly at a surface of the enlarged portion, which is to be brazed. The longitudinal embossments 824 of the gas channels 820 are formed identical to each other and disposed to face each other. The above configuration of the gas channels 820 enables securing flatness and enhancing rigidity when manufacturing a unit. Further, the embossments 824 improve brazing.

Further, in manufacturing the EGR cooler, in order to fix the gas channels 820 or the laminated tube core 800 including the gas channels in the inside of the body shell 100, paste for brazing is required to be spread an area of a surface of an outermost gas channel 820 of the laminated tube core 800. However, in a state where the gas channels 820 are disposed inside of the body shell 200, it is difficult to spread the paste when the gas channels are required to be brazed again. However, as shown in FIG. 7, according to the embodiment, an area of the body shell 100, which comes into contact with the gas channels 820, is provided with a plurality of paste holes 107 vertically parallel to each other. After the paste is spread on a contact surface between the body shell 100 and the laminated tube core 800 through the plurality of paste holes 107, it is possible to braze the gas channels again using the paste.

As described above, the body shell 100 is formed by the assembly of the upper shell piece 100*a* and the lower shell piece 100*b*. Here, the lower shell piece 100*b* is provided with overlapped parts 122*b* and 124*b*, which are overlapped with the upper shell piece 100*a*, respectively at the body lower part 110*b* and the end tank lower parts 120*b*. As shown in FIG. 8, the overlapped part 124*b* of the end tank lower parts 120*b* comes into contact with a portion of an outer surface of the end tank upper parts 120*a* such that the end tank upper parts 120*a* come into contact with the end tank lower parts 120*b*, a gap G occurs.

However, the EGR cooler according to the embodiment includes flanges 500 fittingly coupled to the periphery of a contact portion between the end tank upper parts 120*a* and the end tank lower parts 120*b* while the overlapped part 124*b* of the end tank lower parts 120*b* comes into contact with a portion of an outer surface of the end tank upper parts 120*a*, wherein the flanges 500 supply the end tank parts 120 formed by coupling the end tank upper parts 120*a* with the end tank lower parts 120*b* with a strong clamping force, thereby preventing the gap G. A cross-sectional shape of the end tank parts 120, to which the flanges 500 are connected, may include an annular shape, wherein the flanges 500 evenly supply a clamping force orienting a center of the annular shape.

As shown in FIG. 10, each of the plurality of gas channels 820 is provided with a plurality of embossments 827 at opposite sides thereof. Neighboring gas channels 820 are brazed at the embossments abutting each other.

The invention claimed is:

1. An EGR cooler comprising:

a laminated tube core formed by laminating a plurality of gas channels side by side, wherein a fin structure for improving heat transfer is inserted into the gas channels and opposite ends of the gas channels are open;

a body shell including a body part, in which the laminated tube core is accommodated, and a pair of end tank parts integrally provided at opposite ends of the body part;

coolant pipes connected to the body shell so as to supply coolant to a periphery of the laminated tube core and to discharge the coolant to an outside; and a pair of flanges respectively fittingly coupled to the pair of end tank parts, wherein:

the body shell is formed by assembly of an upper shell piece and a lower shell piece, and is provided with a plurality of paste holes at an area thereof, which comes into contact with the laminated tube core, so as to spread paste for rebrazing;

the upper shell piece includes: a body upper part forming an upper part of the body part; and a pair of end tank upper parts each forming an upper part of the pair of end tank parts; and the lower shell piece includes: a body lower part forming a lower part of the body part; and a pair of end tank lower parts each forming a lower part of the pair of end tank parts.

2. The EGR cooler of claim 1, wherein the plurality of gas channels is each provided with an enlarged portion that has a larger cross-section than the rest of the gas channel, at each of the opposite ends thereof;

neighboring gas channels of the plurality of gas channels meet each other at the enlarged portions to form a grooved portion; and the body shell is provided with an embossment at an inner surface thereof, which comes into contact with the enlarged portion, to be inserted into the grooved portion.

3. The EGR cooler of claim 2, wherein the plurality of gas channels is each provided with linear embossments which are formed at a first surface of the enlarged portion and a second surface of the enlarged portion and grooved toward inside of each of the plurality of gas channels, wherein:

the first surface is opposite to the second surface, the linear embossments formed at the first surface and the second surface are identical to each other and disposed to face each other.

4. The EGR cooler of claim 1, wherein the lower shell piece is provided with step-shaped lip parts, which are configured to overlap the upper shell piece when assembled, respectively at the body lower part and each of the end tank lower parts, wherein the lip part of each of the end tank lower parts comes into contact with an area of an outer surface of an associated end tank upper part, and each of the pair of flanges is fittingly coupled to a periphery of a contact portion between the end tank upper part and the end tank lower part, and thereby supplying a clamping force orienting a center of a cross-section of the end tank part.

5. The EGR cooler of claim 1, wherein each of the plurality of gas channels is provided with a plurality of embossments at opposite sides thereof, wherein neighboring gas channels are brazed at the embossments.

* * * * *